US006773286B1

(12) United States Patent
Wu

(10) Patent No.: US 6,773,286 B1
(45) Date of Patent: Aug. 10, 2004

(54) SPACE-SAVING CABLE CONNECTOR ASSEMBLY WITH BLIND MATE STRUCTURE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/665,843

(22) Filed: Sep. 18, 2003

(51) Int. Cl.[7] ..... H01R 13/74
(52) U.S. Cl. ..... 439/247; 439/557; 439/573
(58) Field of Search ..... 439/247, 248, 439/557, 569–573, 680, 677

(56) References Cited

U.S. PATENT DOCUMENTS 4,647,130 A * 3/1987 Blair et al. ..... 439/248
4,915,641 A * 4/1990 Miskin et al. ..... 439/247
5,199,900 A 4/1993 Hayes, Sr.
5,356,300 A 10/1994 Costello et al.
5,466,171 A 11/1995 Bixler et al.
5,514,000 A * 5/1996 Krause et al. ..... 439/248
5,547,385 A 8/1996 Spangler
5,605,150 A * 2/1997 Radons et al. ..... 600/300
6,290,536 B1 9/2001 Hwang et al.
6,422,885 B2 * 7/2002 Kain et al. ..... 439/247
6,579,111 B2 * 6/2003 Fukamachi ..... 439/247

* cited by examiner

*Primary Examiner*—Hien Vu
(74) *Attorney, Agent, or Firm*—Wei Te Chung

(57) ABSTRACT

A cable connector assembly (8) includes an insulative housing (1), a number of contacts (6) received in the housing, a cable (4) including a number of conductors (40) electrically connecting with the contacts, a cover (2) cooperating with the housing to sandwich the cable therebetween, and a pair of fastening members (5). The housing includes a base (10) and a mating portion (11) projecting from the base. The base comprises an upper surface (105) and an opposite lower surface (107), a pair of ear portions (12) diagonally disposed at opposite ends thereof and extending toward each other, a pair of polarizing keys (106) respectively formed on the upper and the lower surface and arranged in a stagger manner, and a pair of guiding members (13) extending outwardly from the base.

13 Claims, 8 Drawing Sheets

SPACE-SAVING CABLE CONNECTOR ASSEMBLY WITH BLIND MATE STRUCTURE

BACKGROUND OF THE INVENTION

1. Field of the Invention

The present invention generally relates to a cable connector assembly, and more particularly to a space-saving cable connector assembly with blind mate structure.

2. Description of Related Art

Cable connector assemblies are widely used for signal or power transmission between personal computers and peripheral equipments. Such a cable connector assembly is usually needed to be mounted to a panel on which a plurality of connectors are arranged side by side to form a sub module. U.S. Pat. Nos. 4,647,130 and 4,915,641 each disclose such an assembly.

The connector assembly disclosed in U.S. Pat. No. 4,647,130 comprises matable plug and receptacle connectors. The plug connector comprises a pair of flanges diagonally formed at opposite ends of a base thereof and a pair of guide pins disposed at opposite ends of the base and diagonally across from each other. Each flange defines a mounting hole therein and a pair of arcuate projections are located at a substantial angle from the major axis of the plug connector and are around a corresponding mounting hole. A pair of elastomeric ring-like members are secured around a respective pair of projections, thus becoming elongated. A pair of shoulder screws respectively protrude through the mounting holes and the elastomeric ring-like members to tightly engage with the panel. However, this design is relatively complex in structure and the manufacturing cost is relatively high.

U.S. Pat. No. 4,915,641 discloses a pair of matable female and male connectors each mounted to a panel. The female connector comprises a planar mounting flange having mounting apertures therethrough for mounting the assembly to a panel. The male connector comprises a pair of flanges on opposite ends thereof and each flange defines a mounting aperture and a mounting collar therethrough to enable the float mounting of the male connector to an appropriate panel. The collar is a hollow generally cylindrical collar having an aperture dimensioned to receive a bolt, rivet or other connecting means. However, the flanges of the male and the female connectors occupy a relatively big space and the dimension of the male or the female connectors in a longitudinal direction thereof is thus increased.

Hence, an improved space-saving cable connector assembly is highly desired to overcome the disadvantages of the prior art.

SUMMARY OF THE INVENTION

Accordingly, an object of the present invention is to provide a blind mate cable connector assembly with a minimized transverse size.

In order to achieve the object set forth, a cable connector assembly in accordance with the present invention comprises an insulative housing, a plurality of conductive contacts received in the housing, a cable comprising a plurality of conductors electrically connected with the contacts, a cover cooperating with the housing to sandwich the cable between the cover and the housing, and a pair of fastening members for securing the cable connector assembly to a panel. The housing comprises a base and a mating portion projecting outwardly from the base. The base comprises an upper surface and a lower surface both extending along the longitudinal direction, a pair of ear portions diagonally disposed at opposite ends thereof and extending toward each other, a pair of polarizing keys respectively formed on the upper and the lower surfaces and arranged in a stagger manner, and a pair of guiding members extending outwardly from the base and spaced by the mating portion.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
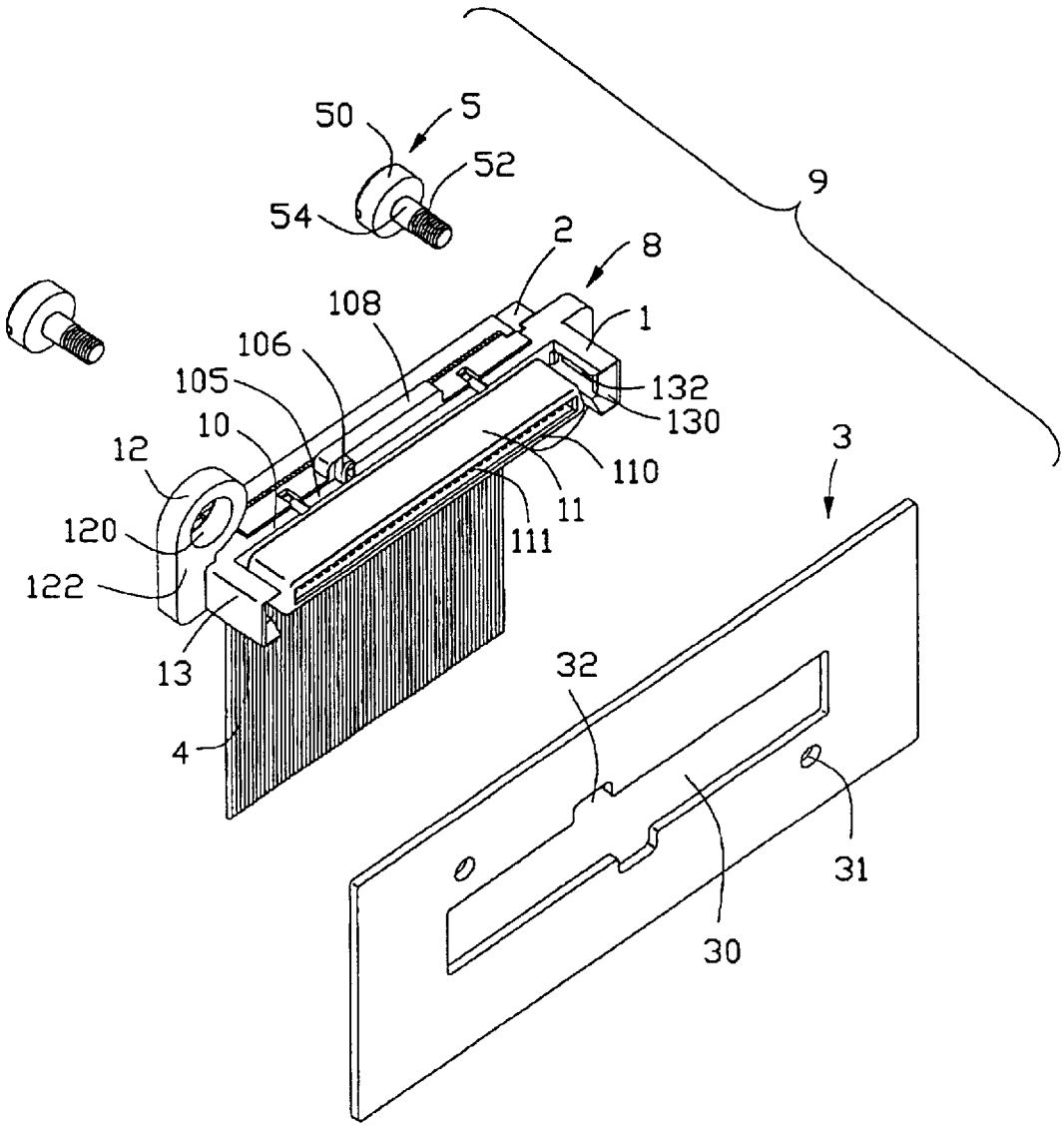
FIG. 1 is a partially exploded, perspective view of a cable connector assembly in accordance with the present invention.
Figure 2:
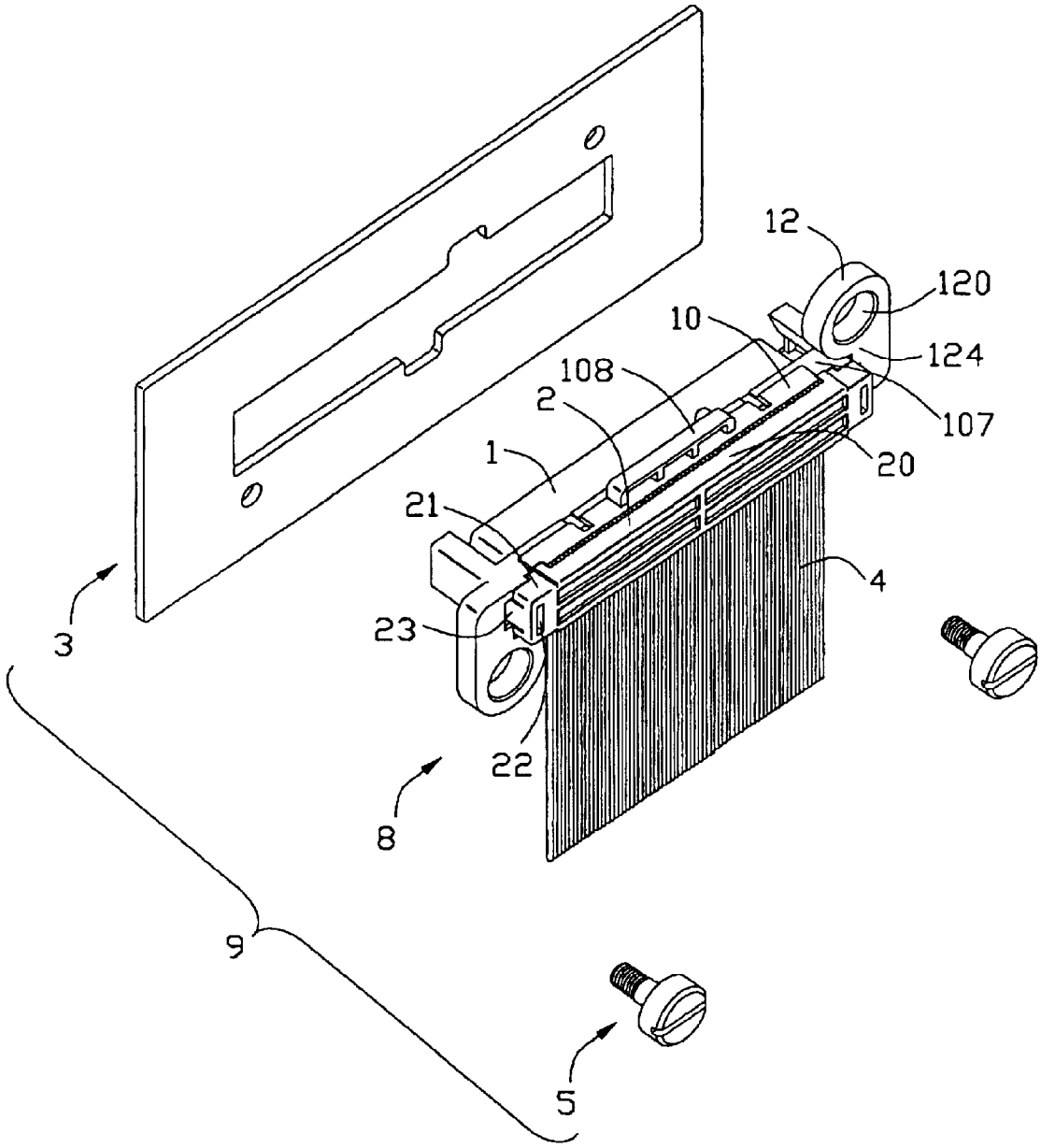
FIG. 2 is a view similar to FIG. 1, but taken from a different aspect.

Referring to FIG. 1 and FIG. 2 in conjunction with FIGS. 5–8, a cable connector assembly 8 in accordance with the present invention, which is mounted to a panel 3 to form a subassembly 9, comprises an insulative housing 1, a plurality of conductive contacts 6 assembled to the insulative housing 1, a flat cable 4 electrically connected with the conductive contacts 6, a cover 2 assembled to the insulative housing 1, a pair of fastening members 5 and a spacer 7 assembled to the insulative housing 1.

The insulative housing 1 is substantially elongated and comprises a base 10 and a mating portion 11 protruding forwardly from a center of the base 10. The insulative housing 1 comprises a mating face 110 and an opposite terminating face 4 (referring to FIG. 6). The insulative housing 1 also defines a mating direction and a longitudinal direction perpendicular to the mating direction.

A pair of ear portions 12 are diagonally disposed at opposite ends of the base 10 and extending along opposite directions. Each ear portion 12 comprises a first face 122 and an opposite second face 124. A mounting aperture 120 extends from the first face 122 to the second face 124 of the ear portion 12. The second face 124 is coplanar with the terminating face 104 of the insulative housing 1. A pair of polarizing keys 106 are respectively disposed on opposite upper and lower surfaces 105, 107 of the base 10 and are arranged in a stagger manner. A pair of bars 108 are respectively disposed on the upper and lower surfaces 105, 107 of the base 10 adjacent a corresponding polarizing key 106. A pair of guiding members 13 protrude outwardly from the base 10 adjacent to the mating portion 11 and beyond the mating face 110. Each guiding member 13 is chamfered to form a lead-in surface 130. Particularly referring to FIG. 8, a U-shaped receiving cavity 132 is formed in each guiding member 13, thus forming a latch section 134.

The mating portion 11 is substantially D-shaped and defines a receiving space 111 recessed toward the terminating face 104 from the mating face 110. A cavity 102 (FIG. 6) is defined in the terminating face 104. Particularly referring to FIGS. 6 and 8, a plurality of passages 112 are defined in opposite longitudinal inner faces of the mating portion 11 and communicate with the cavity 102 and the receiving space 111. A pair of slits 16 are respectively defined through the base 10 and respectively communicate with the receiving cavities 130. A pair of retaining portions 15 extend beyond the terminating face 104 and each is provided with a pair of wedges 150.

The spacer 7 is elongated and is made of insulative material. A plurality of passageways 70 is defined through the spacer 7 corresponding to the passages 112.

Figure 6:
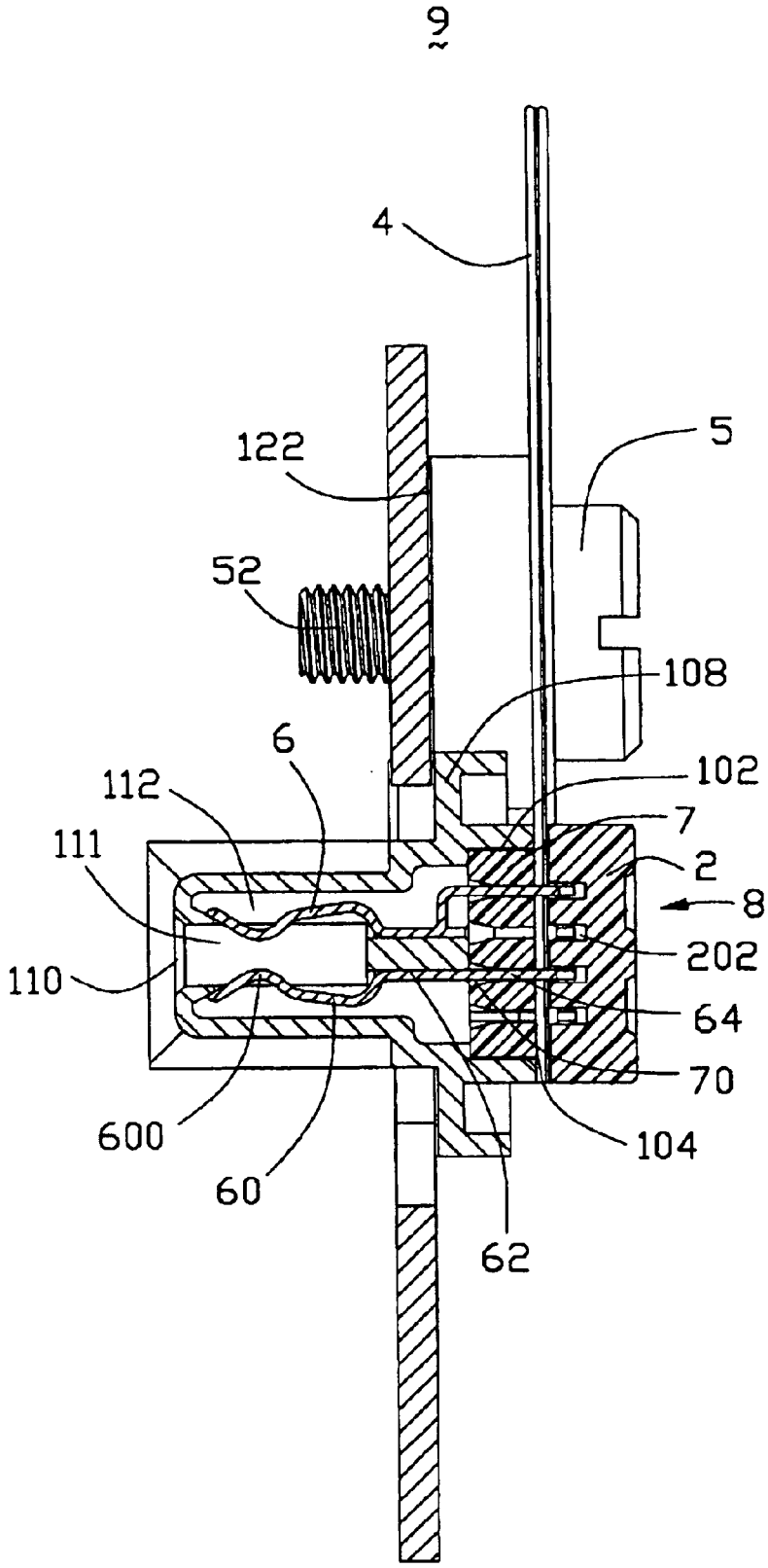
FIG. 6 is a cross-sectional view of the cable connector assembly of FIG. 5 taken along line 6—6.
Figure 8:
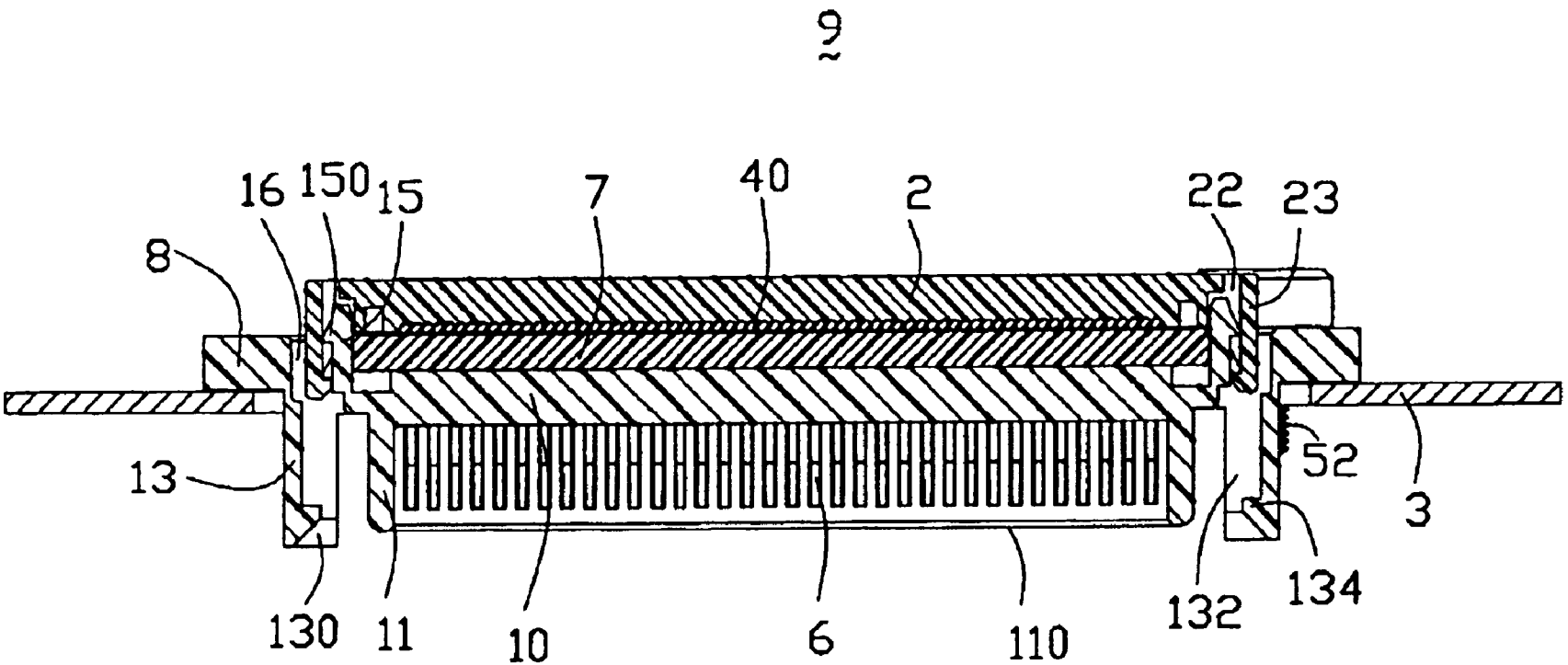
FIG. 8 is a cross-sectional view of the cable connector assembly of FIG. 5 taken along line 8—8.

Referring to FIGS. 1–2 in conjunction with FIG. 6 and FIG. 8, the cover 2 is made of insulative material and comprises a main body 20 and a pair of lateral ends 21. The main body 20 defines a plurality of grooves 202 (FIG. 6) in a front surface thereof. Each lateral end 21 defines a channel 22 therethrough and forms a latch 23 extending outwardly therefrom.

Referring to FIG. 1, in the preferred embodiment, the cable 4 is a flat ribbon cable and comprises a plurality of insulated conductors 40.

Referring to FIG. 6 and FIG. 8, each conductive contact 6 comprises a retention section 62, a mating section 60 extending from one end of the retention section 62 with a curved mating end 600, and a tail section 64 extending from the other end of the retention section 62.

Figure 3:
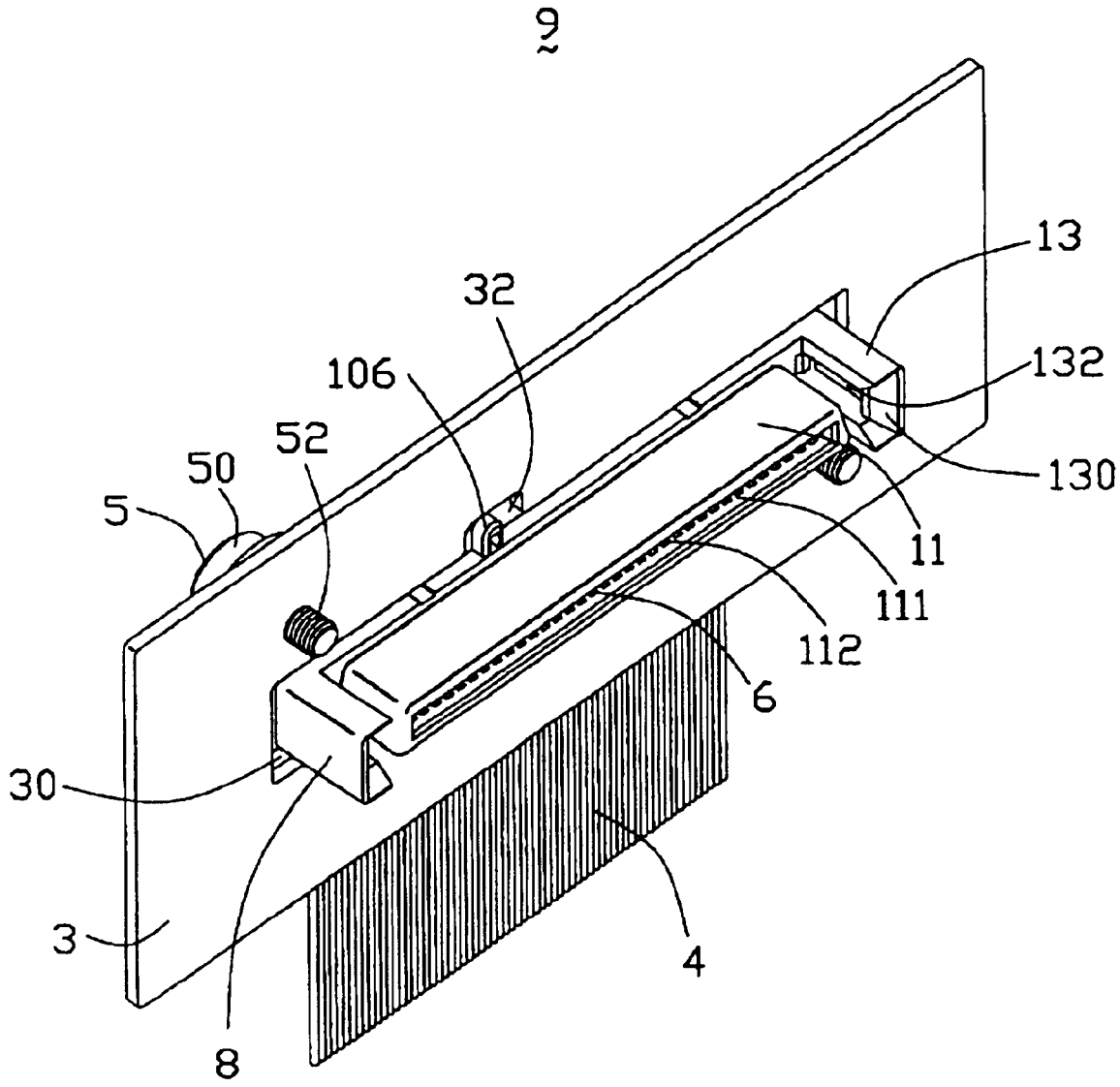
FIG. 3 is an assembled view of FIG. 1.
Figure 4:
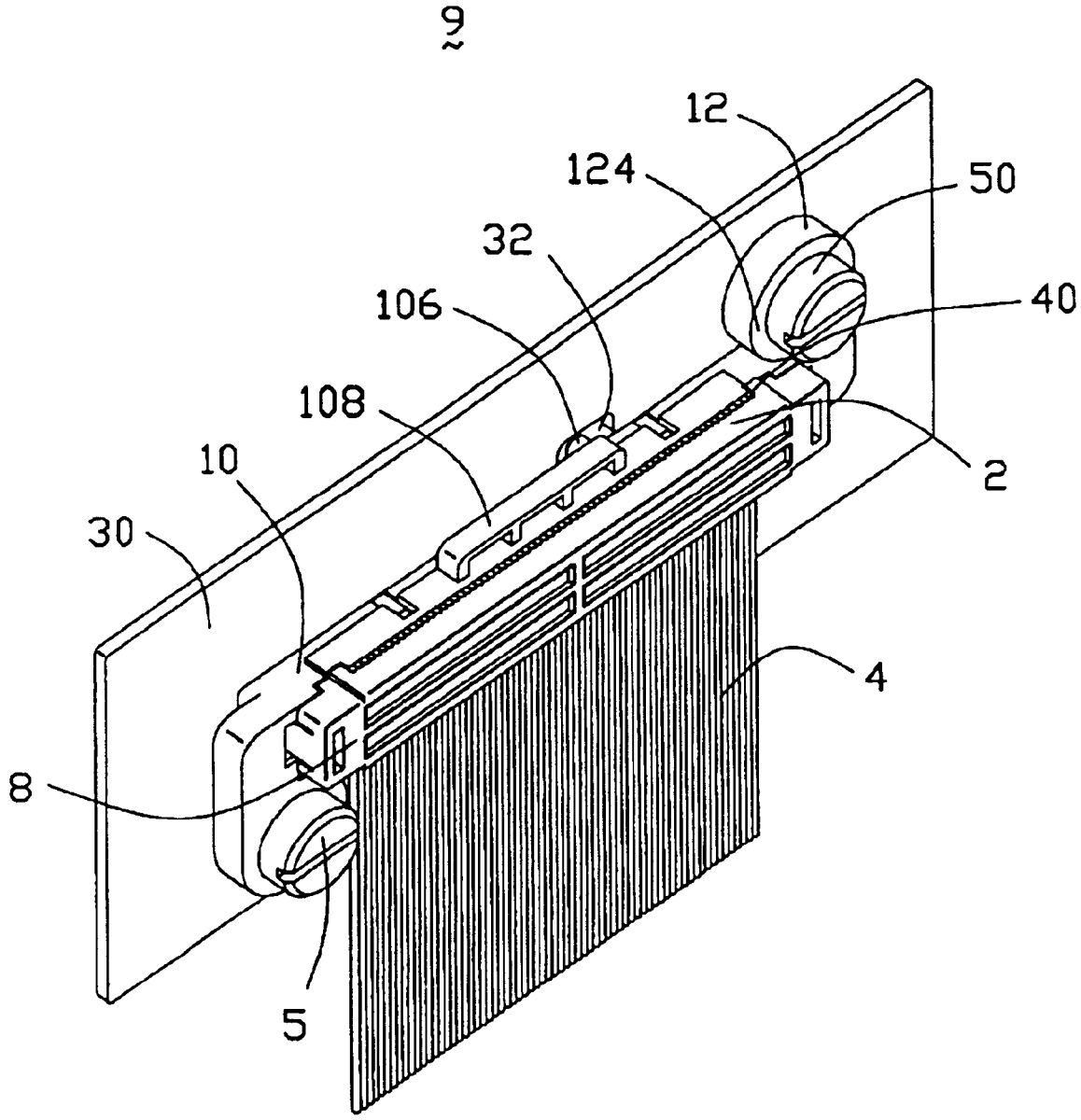
FIG. 4 is a view similar to FIG. 3, but taken from a different aspect.
Figure 5:
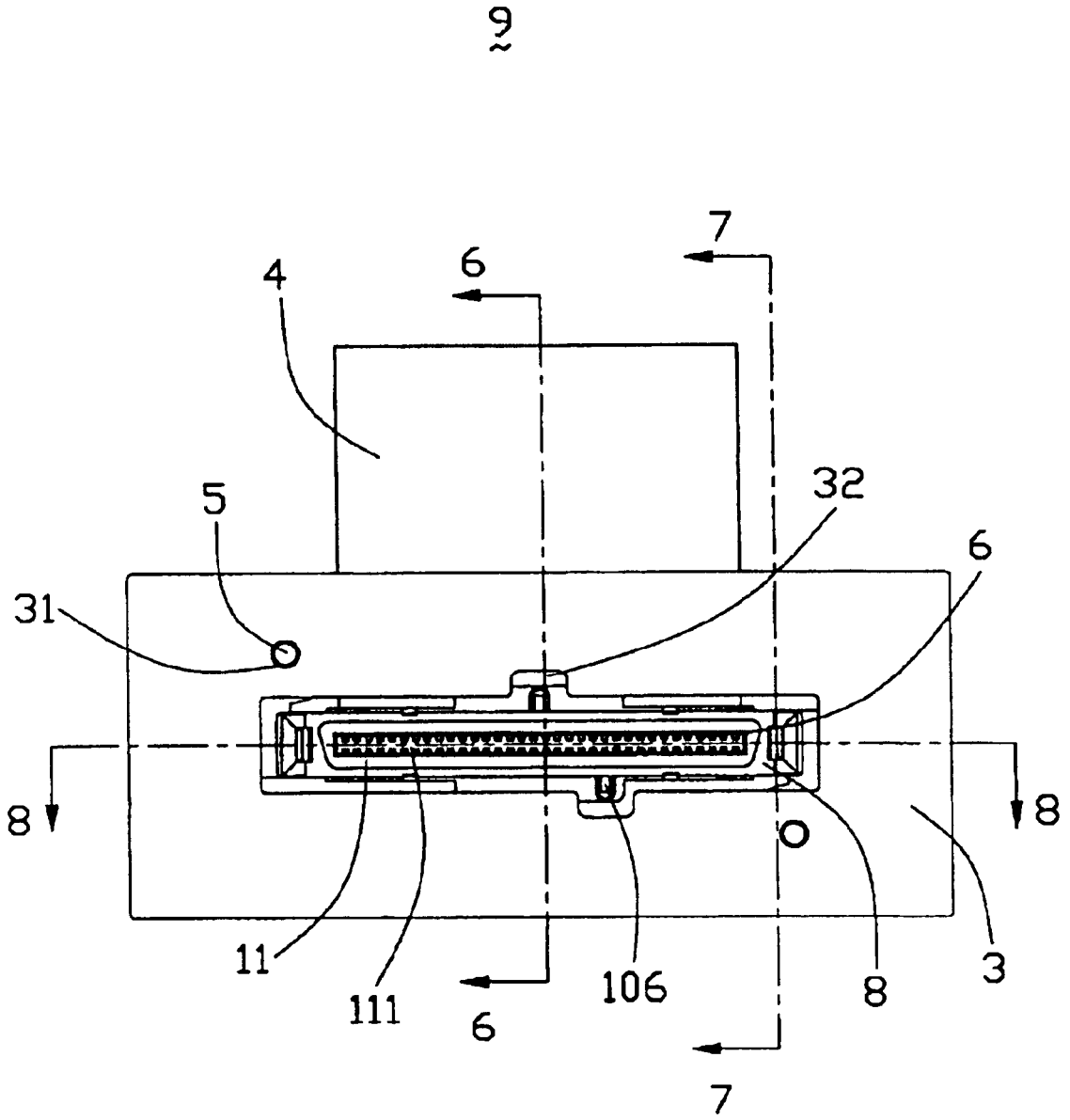
FIG. 5 is a front elevational view of FIG. 3.

Referring to FIGS. 1–3, each fastening member 5 is a jackscrew and comprises an enlarged operating portion 50, a threaded portion 52 and a medial portion 54 interconnecting the operating portion 50 with the threaded portion 52.

Referring to FIGS. 1–3, the panel 3 is a rectangular board and defines a mounting opening 30 in a center thereof and a pair of mounting holes 31 defined at opposite sides of the mounting opening 30. A pair of rectangular polarizing openings 32 are diagonally recessed from opposite upper and lower inner edges of the mounting opening 30 corresponding to the polarizing keys 106.

Figure 7:
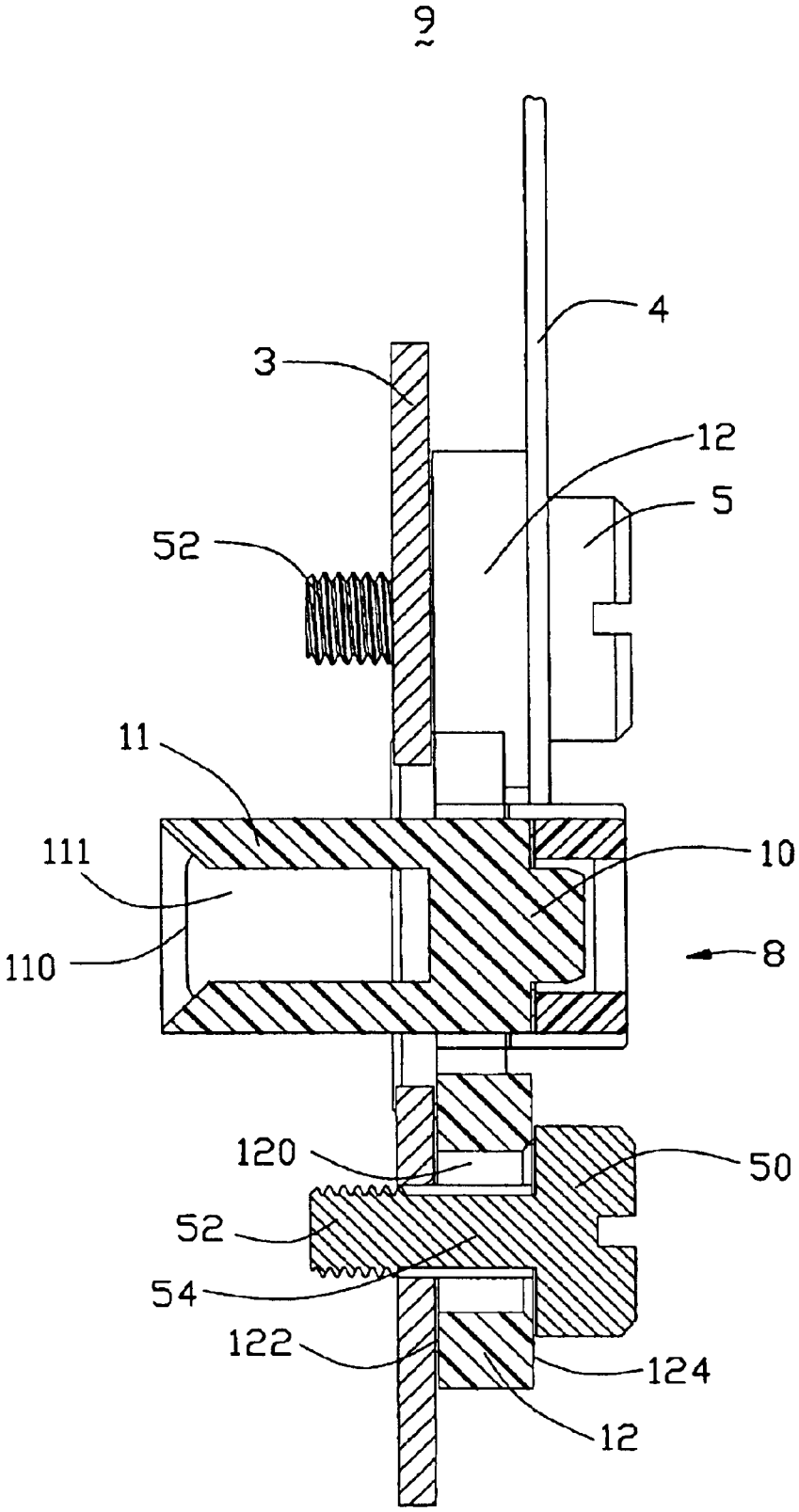
FIG. 7 is a cross-sectional view of the cable connector assembly of FIG. 5 taken along line 7—7.

In assembly of the cable connector assembly 8, referring to FIGS. 1–5 in conjunction with FIGS. 6–8, the conductive contacts 6 are respectively inserted into the passages 112 with the curved mating ends 600 of the mating sections 60 exposed into the receiving space 111. The retention sections 62 interfere fit into corresponding passages 112 for securing the conductive contacts 6 to the insulative housing 1. The spacer 7 is assembled to the insulative housing 1 and is received in the cavity 102. The tail sections 64 protrude through corresponding passageways 70 of the spacer 7 and extend beyond the terminating face 104 of the insulative housing 1. The insulated conductors 40 of the cable 4 are respectively insulation displacement connected with the tail sections 64 to form an electrical connection therebetween.

The insulative cover 2 is assembled to a rear of the insulative housing 1. The pair of latches 23 and the pair of retaining portions 15 are respectively received in the slits 16 of the housing 1 and the channels 22, of the cover 2 to thereby latch with each other. Thus, the cover 2 is securely attached to the insulative housing 1.

Particularly referring to FIG. 3 and FIG. 7, the pair of fastening members 5 respectively protrude through the pair of mounting apertures 120 of the ear portions 12. The operating portion 50 is exposed beyond the second face 124 of the ear portion 12. The medial portion 54 is received in the mounting aperture 120, and the threaded portion 52 is exposed beyond the first face 122 of the ear portion 12.

Referring to FIGS. 1–5 in conjunction with FIGS. 6–8, when the cable connector assembly 8 is assembled to the panel 3, the mating portion 11 and the pair of guiding members 13 extend through the mounting opening 30 until the panel 3 abuts against the bars 108 of the base 10 with the pair of polarizing keys 106 respectively received in the polarizing openings 32. The threaded portions 52 of the fastening member 5 respectively protrude through the mounting holes 31. To secure the cable connector assembly 8 to the panel 3, an operator needs to screw a locking nut (not shown) to the threaded portion 52 of the fastening member 5.

It is noted that the pair of ear portions 12 extend toward each other, thus, a dimension of the housing along the longitudinal direction is decreased. Further, the dimension of the polarizing opening 32 along the longitudinal direction being larger than that of the polarizing key 106, the diameter of the mounting aperture 120 being larger than that of the medial portion 54 of the fastening member 5, thus, the cable connector assembly 8 can move relatively to the panel 3 when mating: with a complementary connector (not shown) to thereby ensure a reliable engagement therebetween. The chamfered lead-in surfaces 130 can guide proper insertion of the cable connector assembly 8 into the complementary connector in blind mate condition. Moreover, the latch section 134 formed in the guiding member 13 can latch with the complementary connector more reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mounting to a panel, comprising:

an insulative housing defining a mating direction and a longitudinal direction perpendicular to the mating direction and comprising a base and a mating portion projecting outwardly from the base along the mating direction, the base comprising an upper surface and an opposite lower surface both extending along said longitudinal direction, a pair of ear portions diagonally disposed at opposite ends thereof and extending toward each other along said longitudinal direction, and a pair of polarizing keys respectively formed on the upper and the lower surfaces thereof and arranged in a stagger manner;

a plurality of conductive contacts received in the insulative housing;

a cable comprising a plurality of conductors respectively electrically connecting with the conductive contacts; and a pair of fastening members protruding through the ear portions of the insulative housing and adapted for securing to the panel;

wherein the insulative housing comprises a mating face and a terminating face opposite to the mating face and defines a cavity recessed from the terminating face toward the mating face to receive a spacer;

wherein the insulative housing forms a retaining portion extending beyond the terminating face thereof and a slit beside the retaining portion, wherein the insulative cover forms a latch received in the slit and latching the retaining portion;

wherein the slit communicates with the receiving cavity of the guiding member; and wherein an insulative cover cooperates with the insulative housing to sandwich the cable between the cover and the insulative housing.

2. The cable connector assembly as claimed in claim 1, further comprising a pair of guiding members extending outwardly from the base and arranged at opposite sides of the mating portion.

3. The cable connector assembly as claimed in claim 2, wherein the guiding member defines a receiving cavity and form a latch section.

4. The cable connector assembly as claimed in claim 2, wherein the guiding member is chamfered to form a lead-in surface.

5. The cable connector assembly as claimed in claim 3, wherein the guiding member is U-shaped.

6. The cable connector assembly as claimed in claim 1, wherein the insulative housing defines a plurality of passages to receive the conductive contacts, and wherein the spacer defines a plurality of passageways corresponding to the passages, each conductive contact comprising a tail section respectively protruding through the passageway of the spacer and extending beyond the terminating face.

7. The cable connector assembly as claimed in claim 6, wherein the housing defines a receiving space recessed from the mating face toward the terminating face and communicating with the passages, and wherein each conductive contact comprises a mating section forming a curved mating end exposed in the receiving space.

8. The cable connector assembly as claimed in claim 1, wherein the base comprises a pair of bars adjacent to corresponding polarizing keys.

9. The cable connector assembly as claimed in claim 1, wherein the mating portion is D-shaped.

10. The cable connector assembly as claimed in claim 1, wherein the ear portion comprises a first face and a second face opposite to the first face, each fastening member comprises an enlarged operating portion near the second face of the ear portion, a threaded portion near the first face of the ear portion and a medial portion interconnecting the operating portion and the threaded portion.

11. A system comprising:

a panel defining a mounting opening, a pair of mounting holes at opposite sides of the mounting opening and a pair of polarizing openings recessed from opposite upper and lower inner edges of the mounting opening and arranged in a stagger manner; and a cable connector assembly comprising:

an insulative housing defining a mating direction and a longitudinal direction perpendicular to the mating direction and comprising a base and a mating portion projecting outwardly from the base along the mating direction and through the mounting opening of the panel, the base comprising a pair of ear portions diagonally disposed at opposite ends thereof and extending toward each other along said longitudinal direction, and a pair of polarizing keys formed adjacent to respective ear portions and diagonally spaced by the mating portion, the pair of polarizing keys respectively received in the polarizing openings of the panel, the dimension of the polarizing opening of the panel along said longitudinal direction being larger than that of the polarizing key;

a plurality of conductive contacts received in the insulative housing;

a cable comprising a plurality of conductors respectively electrically connecting with the conductive contacts; and a pair of fastening members protruding members respectively protruding through the ear portions and the mounting holes of the panel to secure the cable connector assembly to the panel;

wherein the insulative housing comprises a mating face and a terminating face opposite to the mating face and defines a cavity recessed from the terminating face toward the mating face to receive a spacer;

wherein the insulative housing forms a retaining portion extending beyond the terminating face thereof and a slit beside the retaining portion, wherein the insulative cover forms a latch received in the slit and latching the retaining portion;

wherein an insulative cover cooperates with the insulative housing to sandwich the cable between the cover and the insulative housing.

12. The subassembly as claimed in claim 11, wherein the base of the cable connector assembly further comprises a pair of guiding members extending forwardly and arranged at opposite sides of the mating portion.

13. A cable connector assembly comprising:

an insulative housing defining a base along a longitudinal direction thereof;

a mating portion extending forwardly from the base and defining a mating direction perpendicular to said longitudinal direction;

a pair of guiding members forwardly extending from the base and by two sides of the mating portion, respectively;

a cable comprising a plurality of conductors respectively electrically connecting with a plurality of contacts disposed in the housing;

a first mounting ear integrally formed at one end of the base and generally aligned with the corresponding one of said guiding members in a first transverse direction perpendicular to both said longitudinal direction and said mating direction; and a second mounting ear integrally formed at the other end of the base and generally aligned with another corresponding one of said guiding members in a second transverse direction perpendicular to both said longitudinal direction and said mating direction while opposite to said first transverse direction;

a panel abuts against said base;

wherein said panel defines an opening receiving said mating portion, and a pair of mounting holes located by two different longitudinal sides of said opening and offset from each other along said longitudinal direction;

wherein said panel further includes a pair of recesses communicatively by two different longitudinal sides of the opening and offset from each other along said longitudinal direction;

wherein said base further includes a pair of keys at different longitudinal positions thereof for receipt in the corresponding recesses, respectively; and wherein an insulative cover cooperates with the insulative housing to sandwich the cable between the cover and the insulative housing.

* * * * *